US006860753B2

(12) United States Patent
Wang

(10) Patent No.: US 6,860,753 B2
(45) Date of Patent: Mar. 1, 2005

(54) LIGHT SOURCE FOR FLAT PANEL DISPLAY DEVICE AND BACKLIGHT MODULE USING THE SAME

(75) Inventor: Yao Tung Wang, Chiai (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 0 days.

(21) Appl. No.: 10/243,939

(22) Filed: Sep. 16, 2002

(65) Prior Publication Data

US 2003/0068922 A1 Apr. 10, 2003

(30) Foreign Application Priority Data

Sep. 20, 2001 (TW) ..... 90216121 U

(51) Int. Cl.[7] ..... F21V 7/04; H01R 13/58
(52) U.S. Cl. ..... 439/451; 362/31
(58) Field of Search ..... 362/31; 349/65, 349/58, 70; 439/451, 452, 502

(56) References Cited

U.S. PATENT DOCUMENTS 1,398,228 A * 11/1921 Grigsby ..... 439/447
5,280,372 A * 1/1994 Horiuchi ..... 349/65
5,946,062 A * 8/1999 Hasegawa et al. ..... 349/58
6,386,722 B2 * 5/2002 Okumura ..... 362/31
6,459,203 B1 * 10/2002 Kim ..... 315/70
6,667,779 B2 * 12/2003 Lee ..... 349/58

* cited by examiner

*Primary Examiner*—Neil Abrams
(74) *Attorney, Agent, or Firm*—Bacon & Thomas

(57) ABSTRACT

A light source for a flat panel display device is disclosed. The light source comprising: a lamp tube having a first connector at one end thereof and a second connector at the opposite end thereof; a first leading wire connecting with the first connector; a second leading wire connecting with the second connector; and an electric plug adapted for fixing the first leading wire and the second leading wire both extending from the second connector; wherein the length of the second leading wire between the second connector and the electric plug is longer than the length of the first leading wire between the second connector and the electric plug. Therefore, the major part of the applied stress on the wires can be substantially distributed through the first leading wire and the breakagE of the lamp tube at the area around the second connector can be effectively prevented.

7 Claims, 1 Drawing Sheet

LIGHT SOURCE FOR FLAT PANEL DISPLAY DEVICE AND BACKLIGHT MODULE USING THE SAME

BACKGROUND OF THE INVENTION

1. Field of the Invention

The present invention relates to a light source for a flat panel display and, more particularly, to a light source suitable for use in a liquid crystal display device.

2. Description of Related Art

The leading wires of the lamp tube of the light source of a liquid crystal display device tend to be stretched, bent or knocked during processing process or delivery. When the leading wires are stretched, bent or knocked during processing process, the connection or the bonding between the glass and the metal electrodes, which locate at the ends of the lamp, may break, and thereby disables the liquid crystal display device to function.

Therefore, it is desirable to provide a high tensile strength light source for a flat panel display device that eliminates the aforesaid drawbacks.

SUMMARY OF THE INVENTION

It is the main object of the present invention to provide a light source for a flat panel display device that has a high tensile strength and better resistance against breakage.

To achieve these and other objects of the present invention, the light source for high tensile strength flat panel display device comprises a lamp tube having a first connector at one end thereof and a second connector at an opposite end thereof; a first leading wire connecting with said first connector; a second leading wire connecting with said second connector; and an electric plug adapted for fixing said first leading wire and said second leading wire extending from said second connector; wherein said second connector has a connecting hole or a fixing frame to fix said first leading wire extending from said first connector, and the length of said second leading wire between said second connector and said electric plug is longer than the length of said first leading wire between said second connector and said electric plug.

The backlight module for a flat panel display device comprising at least one light source for flat panel display illustrated above is also disclosed. The backlight module of the present invention can also comprises other related conventional components such as a lightguide, a reflector, at least a diffuser film and at least a prism film to increase the function of the backlight module.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
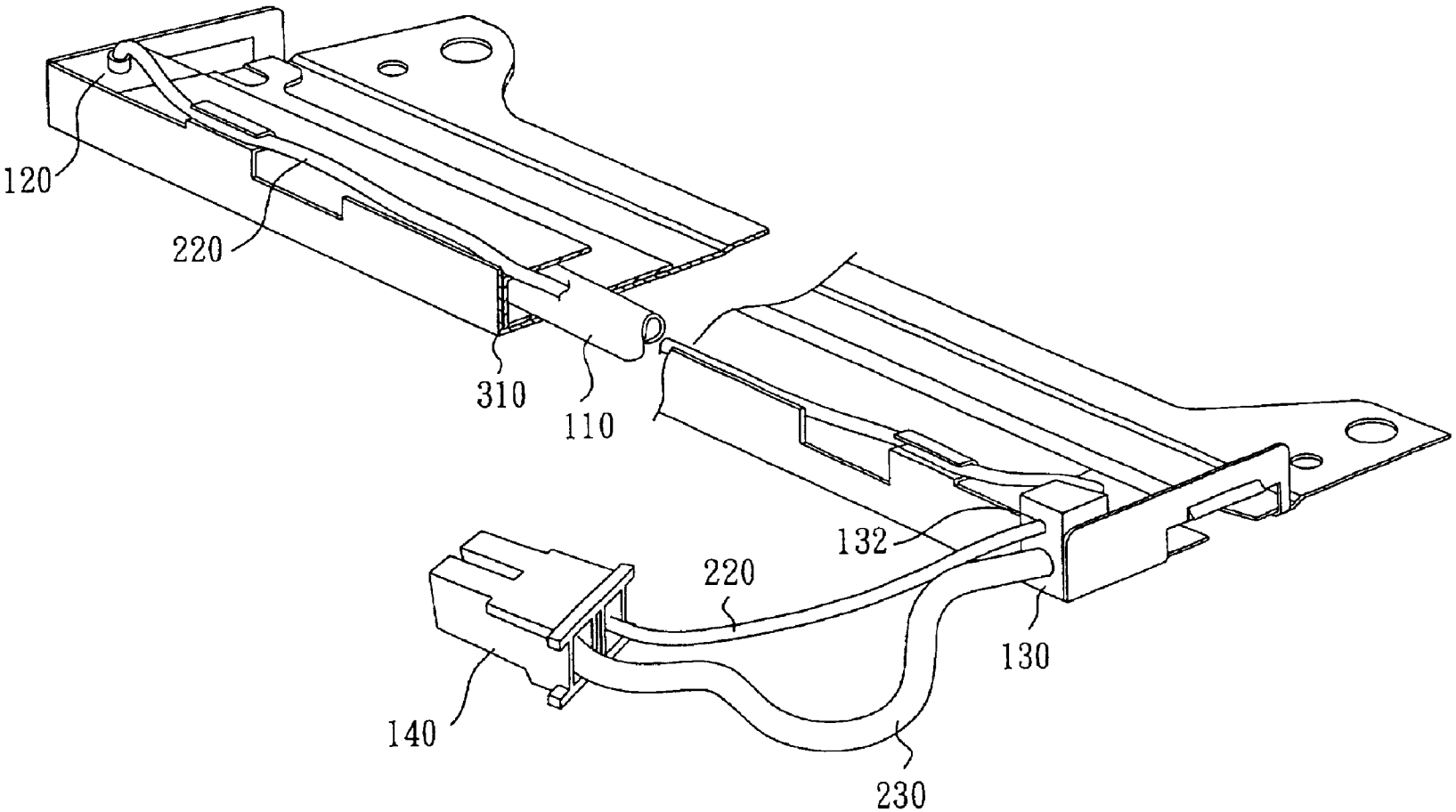
FIG. 1 is a schematic drawing showing the structure of a light source for flat panel display according to the present invention.

According to the present invention, the length of said second leading wire between said second connector and said electric plug is longer than the length of said first leading wire between said second connector and said electric plug. Preferably, the length of said second leading wire between said second connector and said electric plug is at least 1 mm longer than the length of said first leading wire between said second connector and said electric plug. Most preferably, the length of said second leading wire between said second connector and said electric plug is at least 5 mm longer than the length of said first leading wire between said second connector and said electric plug. The flat panel display device of the present invention can be any conventional flat panel display. Preferably, the flat panel display device of the present invention is a liquid crystal display device. The light source for the flat panel display of the present invention can be used in a backlight module for a flat panel display device.

Referring to FIG. 1, a light source for a flat panel display device according to the present invention is shown. The flat panel display device according to the present embodiment includes a lamp tube 110, a first connector 120, a second connector 130, a first leading wire 220, a second leading wire 230, and an electric plug 140. The lamp tube 110 has a first connector 120 atone end and a second connector 130 at the other end, wherein each connector is connected with leading wires. The first connector 120 connects with the first leading wire 220 whose diameter is smaller, and the first leading wire 220 extends to the second connector 130 of the lamp tube 110 along the external fringe of the reflector 310. The second connector 130 connects with the second leading wire 230 whose diameter is larger, and the second leading wire 230 extends from the second connector 130 to an electric plug 140. When extending to the second connector 130, the first leading wire 220 passes through the fixing hole 132 of the second connector 130 and is fixed on it, and then the first leading wire 220 keeps extending until it connects with the electric plug 140. The length of the second leading wire 230 between the second connector 130 and the electric plug 140 is at least 5 mm longer than the length of the first leading wire 220 between the second connector 130 and the electric plug 140.

The light source of the present embodiment illustrated above can combines with other components such as a lightguide, a reflector, two diffuser films, and two prism films to form a backlight module for a flat panel display. The backlight module of the present invention can further include at least one frame to mount the light source and other components illustrated above.

After the aforesaid light source is installed in a backlight module and then is further installed in a liquid crystal display device, the liquid crystal display device thus obtained was tested on tensile strength by means of using a tension scale to apply a tension force to the electric plug in a direction parallel to the lamp tube as well as in a direction perpendicular to the lamp tube. According to the tests, the lamp tube and the liquid crystal display device show shows no breakage when the tension force up to 3 Kg/mm is applied in a direction parallel to the lamp tube as well as in a direction perpendicular to the lamp tube. This fact indicates that the light source for the flat panel display device does not break when receiving a tension force as high as 3 Kg/mm in a direction parallel to the lamp tube or in a direction perpendicular to the lamp tube.

As indicated above, the two leading wires of the light source of the present invention have different lengths. The length of the first leading wire between the second connector and the electric plug is designed to be shorter than the length of the second leading wire between the second connector and the electric plug. Therefore, when stretched force is applied during the installation of the light source, the major part of the applied force or stress is distributed through the first leading wire, and the second leading wire receives less force to avoid the breaking of the lamp tube. Furthermore, since the first leading wire extended from the first connector to the second connector is along a straight line and then extended through the second connector at right angles, the applied force or stress can be distributed along the new structure mentioned above effectively. Therefore, the stress for stretching the electric plug can be distributed and the breakage on the lamp tube at the area around the second connector can be effectively avoided.

Although the present invention has been explained in relation to its preferred embodiments, it is to be understood that many other possible modifications and variations can be made without departing from the spirit and scope of the invention as hereinafter claimed.

What is claimed is:

1. A light source for a flat panel display device comprising: a lamp tube having a first connector at one end thereof and a second connector at an opposite end thereof;

a first leading wire connecting with said first connector;

a second leading wire connecting with said second connector which has a connecting hole or a fixing frame to fix said first leading wire extending from said first connector; and an electric plug adapted for fixing said first leading wire and said second leading wire both extending from said second connector, wherein the length of said second leading wire between said second connector and said electric plug is longer than the length of said first leading wire between said second connector and said electric plug to distribute a major part of stress applied on said first leading wire and said second leading wire through said first leading wire.

2. The light source as claimed in claim 1, wherein the length of said second leading wire between said second connector and said electric plug is at least 1 mm longer than the length of said first leading wire between said second connector and said electric plug.

3. The light source as claimed in claim 1, wherein the length of said second leading wire between said second connector and said electric plug is at least 5 mm longer than the length of said first leading wire between said second connector and said electric plug.

4. The light source as claimed in claim 1, wherein the flat panel display is a liquid crystal display device.

5. A backlight module for a flat panel display device comprising at least one said light source for a flat panel display as claimed in claim 1.

6. The backlight module as claimed in claim 5, wherein the length of said second leading wire between said second connector and said electric plug is at least 1 mm longer than the length of said first leading wire between said second connector and said electric plug.

7. The backlight module as claimed in claim 5, wherein the length of said second leading wire between said second connector and said electric plug is at least 5 mm longer than the length of said first leading wire between said second connector and said electric plug.

* * * * *